US007403160B2

(12) United States Patent
Chiang et al.

(10) Patent No.: US 7,403,160 B2
(45) Date of Patent: Jul. 22, 2008

(54) LOW PROFILE SMART ANTENNA FOR WIRELESS APPLICATIONS AND ASSOCIATED METHODS

(75) Inventors: Bing A. Chiang, Melbourne, FL (US); Michael J. Lynch, Merritt Island, FL (US); Douglas H. Wood, Palm Bay, FL (US); Thomas Liu, Melbourne, FL (US); Govind R. Kadambi, Melbourne, FL (US); Mark W. Kishler, Melbourne, FL (US)

(73) Assignee: Interdigital Technology Corporation, Wilmington, DE (US)

( * ) Notice: Subject to any disclaimer, the term of this patent is extended or adjusted under 35 U.S.C. 154(b) by 0 days.

(21) Appl. No.: 11/154,428

(22) Filed: Jun. 16, 2005

(65) Prior Publication Data

US 2005/0280589 A1 Dec. 22, 2005

Related U.S. Application Data

(60) Provisional application No. 60/636,926, filed on Dec. 17, 2004, provisional application No. 60/587,970, filed on Jul. 14, 2004, provisional application No. 60/580,561, filed on Jun. 17, 2004.

(51) Int. Cl.
*H01Q 1/24* (2006.01)
*H01Q 19/02* (2006.01)

(52) U.S. Cl. ..... 343/702; 343/833; 343/834

(58) Field of Classification Search ..... 343/702, 343/752, 833, 834, 829, 846, 818; 455/575.7
See application file for complete search history.

(56) References Cited

U.S. PATENT DOCUMENTS 3,846,799 A 11/1974 Gueguen ..... 343/833
5,905,473 A 5/1999 Taenzer ..... 343/834
6,337,668 B1 * 1/2002 Ito et al. ..... 343/833
6,369,770 B1 4/2002 Gothard et al. ..... 343/794
6,392,599 B1 * 5/2002 Ganeshmoorthy et al. .. 343/700 MS
6,476,773 B2 11/2002 Palmer et al. ..... 343/795
6,480,157 B1 11/2002 Palmer et al. ..... 343/700 MS
6,753,826 B2 6/2004 Chiang et al. ..... 343/834

(Continued)

FOREIGN PATENT DOCUMENTS

JP 56012102 2/1981

(Continued)

OTHER PUBLICATIONS

Ohira et al., Electronically Steerable Passive Array Radiator Antennas for Low-Cost Analog Adaptive Beamforming, 0-7803-6345-0/00, 2000, IEEE.

(Continued)

*Primary Examiner*—Michael C Wimer
(74) *Attorney, Agent, or Firm*—Allen, Dyer, Doppelt, Milbrath & Gilchrist, P.A.

(57) ABSTRACT

A low profile smart antenna includes an active antenna element carried by a dielectric substrate, and active antenna element has a T-shape. Passive antenna elements are carried by the dielectric substrate, and they have an inverted L-shaped portion laterally adjacent the active antenna element. Impedance elements are selectively connectable to the passive antenna elements for antenna beam steering.

34 Claims, 9 Drawing Sheets

U.S. PATENT DOCUMENTS

| | | | | |
|---|---|---|---|---|
| 6,876,331 | B2 | 4/2005 | Chiang et al. | 343/702 |
| 6,972,729 | B2 * | 12/2005 | Wang | 343/833 |
| 2004/0046694 | A1 | 3/2004 | Chiang et al. | 342/360 |

FOREIGN PATENT DOCUMENTS

| | | |
|---|---|---|
| WO | 03/065500 | 8/2003 |
| WO | 2004/025778 | 3/2004 |

OTHER PUBLICATIONS

Scott et al., Diversity Gain From a Single-Port Adaptive Antenna Using Switched Parasitic Elements Illustrated with a Wire and Monopole Prototype, IEEE Transactions on Antennas and Propagation, vol. 47, No. 6, Jun. 1999.

King, The Theory of Linear Antennas, pp. 622-637, Harvard University Press, Cambridge, Mass., 1956.

Lo et al., Antenna Handbook: Theory, Applications and Design, pp. 21-38, Van Nostrand Reinhold Co., New York, 1988.

Svantesson et al., High-Resolution Direction Finding Using a Switched Parasitic Antenna, Aug. 2001.

Basilio et al., The Dependence of the Input Impedance on Feed Position of Probe and Microstrip Line-Fed Patch Antennas, IEEE Transactions on Antennas and Propagation, vol. 49, No. 1, Jan. 2001, pp. 45-47.

Schlub et al., Switched Parasitic Antenna on a Finite Ground Plane with Conductive Sleeve, IEEE Transactions on Antennas and Propagation, vol. 52, No. 5, May 2004, pp. 1343-1347.

Taguchi et al., Aeronautical Low-Profile YAGI-UDA Antennas, Electronics & Communications In Japan, Part I—Communications, Wiley, Hoboken, New Jersey, vol. 81, No. 12, Dec. 1998, pp. 28-36.

* cited by examiner

LOW PROFILE SMART ANTENNA FOR WIRELESS APPLICATIONS AND ASSOCIATED METHODS

RELATED APPLICATION

This application claims the benefit of U.S. Provisional Application Ser. Nos. 60/580,561 filed Jun. 17, 2004, 60/587,970 filed Jul. 14, 2004 and 60/636,926 filed Dec. 17, 2004, the entire contents of which are incorporated herein by reference.

FIELD OF THE INVENTION

The present invention relates to the field of wireless communications, and more particularly, to a low profile smart antenna for use with a mobile subscriber unit.

BACKGROUND OF THE INVENTION

In wireless communication systems in which portable or mobile subscriber units communicate with a base station, such as a CDMA2000 communication system, the mobile subscriber unit is typically a hand-held device, such as a cellular telephone, for example. In some embodiments, the antenna protrudes from the housing or enclosure of the mobile subscriber unit. The antenna may be a protruding monopole or dipole antenna, for example. A monopole or dipole antenna is limited to a fixed pattern, such as an omni-directional antenna pattern.

Another type of antenna used with mobile subscriber units is a switched beam antenna. A switched beam antenna system generates a plurality of antenna beams including an omni-directional antenna beam and one or more directional antenna beams. Directional antenna beams provide higher antenna gains for advantageously increasing the communications range between the base station and the mobile subscriber unit, and for also increasing network throughput. A switched beam antenna is also known as a smart antenna or an adaptive antenna array.

U.S. Pat. No. 6,876,331 discloses a smart antenna for a mobile subscriber unit. This patent is assigned to the current assignee of the present invention, and is incorporated herein by reference in its entirety. In particular, the smart antenna includes an active antenna element and a plurality of passive antenna elements protruding from the housing of the mobile subscriber unit.

Protrusion of the various types of antennas from the housing of a mobile subscriber unit may be broken or damaged when carried by a user, particularly for smart antennas. Even minor damage to a protruding antenna can significantly change its operating characteristics. In addition, lengthy protrusions take away from the appearance of mobile subscriber units.

SUMMARY OF THE INVENTION

In view of the foregoing background, it is therefore an object of the present invention to reduce the height of a smart antenna protruding from the housing of a mobile subscriber unit to improve portability and appearance.

This and other objects, features, and advantages in accordance with the present invention are provided by a smart antenna comprising a dielectric substrate, an active antenna element carried by the dielectric substrate and having a T-shape, and at least one passive antenna element carried by the dielectric substrate and comprising an inverted L-shaped portion laterally adjacent the active antenna element. At least one impedance element is selectively connectable to the at least one passive antenna element for antenna beam steering.

The inverted L-shaped portions of the passive antenna elements and the T-shaped active antenna element significantly reduce the height of the antenna elements protruding from a housing of a mobile subscriber unit, which improves portability and appearance.

In other embodiments of the mobile subscriber unit, the smart antenna may be internal the housing. That is, the reduced height of the active and passive antenna elements advantageously allows the smart antenna to be enclosed by the housing instead of protruding therefrom.

The active antenna element may include a bottom portion and a top portion connected thereto for defining the T-shape, and wherein the bottom portion has a meandering shape. In addition, the top portion may be symmetrically arranged with respect to the first portion, and includes a pair of inverted L-shaped ends.

The smart antenna may further comprise at least one switch carried by the dielectric substrate for selectively connecting the at least one passive antenna element to the at least one impedance element. A respective impedance element may be associated with each passive antenna element, and each impedance element may comprise an inductive load and a capacitive load. The inductive and capacitive loads may be selectively connectable to the passive antenna elements for generating antenna beams including an omni-directional antenna beam and a plurality of directional antenna beams.

Each passive antenna element may further comprise a first elongated portion connected to the L-shaped portion via the at least one impedance element. Since a length of the L-shaped portions of the passive antenna elements and a length of the active antenna element has been reduced, the first elongated portions are generally longer in length.

Consequently, another aspect of the present invention is to reduce the overall length of the smart antenna as well as improving the bandwidth. This is accomplished by forming a loop in each first elongated portion with an opening in one side thereof. Each first elongated portion may further comprise an impedance element connected to the loop across the opening. In addition, the loop and the impedance element can be effectively used to counter any ill effects of the coupling resulting from the close proximity of the antenna to the ground plane.

Yet another aspect of the present invention is directed to providing a low profile, dual-band smart antenna. As noted above, the first elongated portions may be connected to the L-shaped portions of the passive antenna elements via the impedance elements. Currently, this antenna configuration operates over a particular frequency band, such as 1.75 GHz to 2.5 GHz (i.e., high-band), for example.

To operate at a lower frequency band, such as 824 MHz to 960 MHz, for example, a second active antenna element may be connected parallel to the active antenna element, and a filter and a second elongated portion may be connected to the respective first elongated portions. In operation, the filter electrically connects the second elongated portions to operate over the low-band, i.e., 824 MHz to 960 MHz, for example.

Another aspect of the present invention is directed to a method for making a smart antenna as described above.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Figure 1:
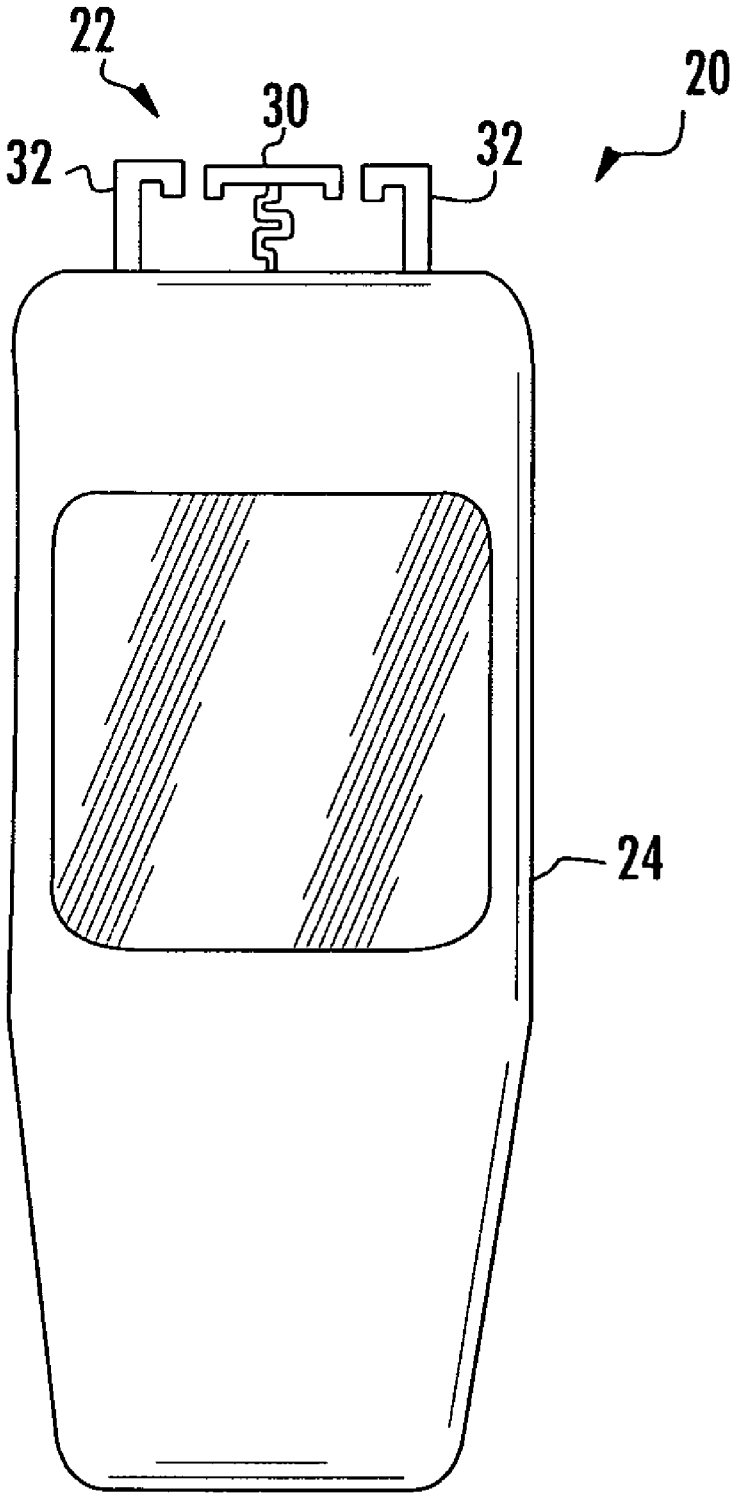
FIG. 1 is a schematic diagram of a mobile subscriber unit with a smart antenna in accordance with the present invention.
Figure 2:
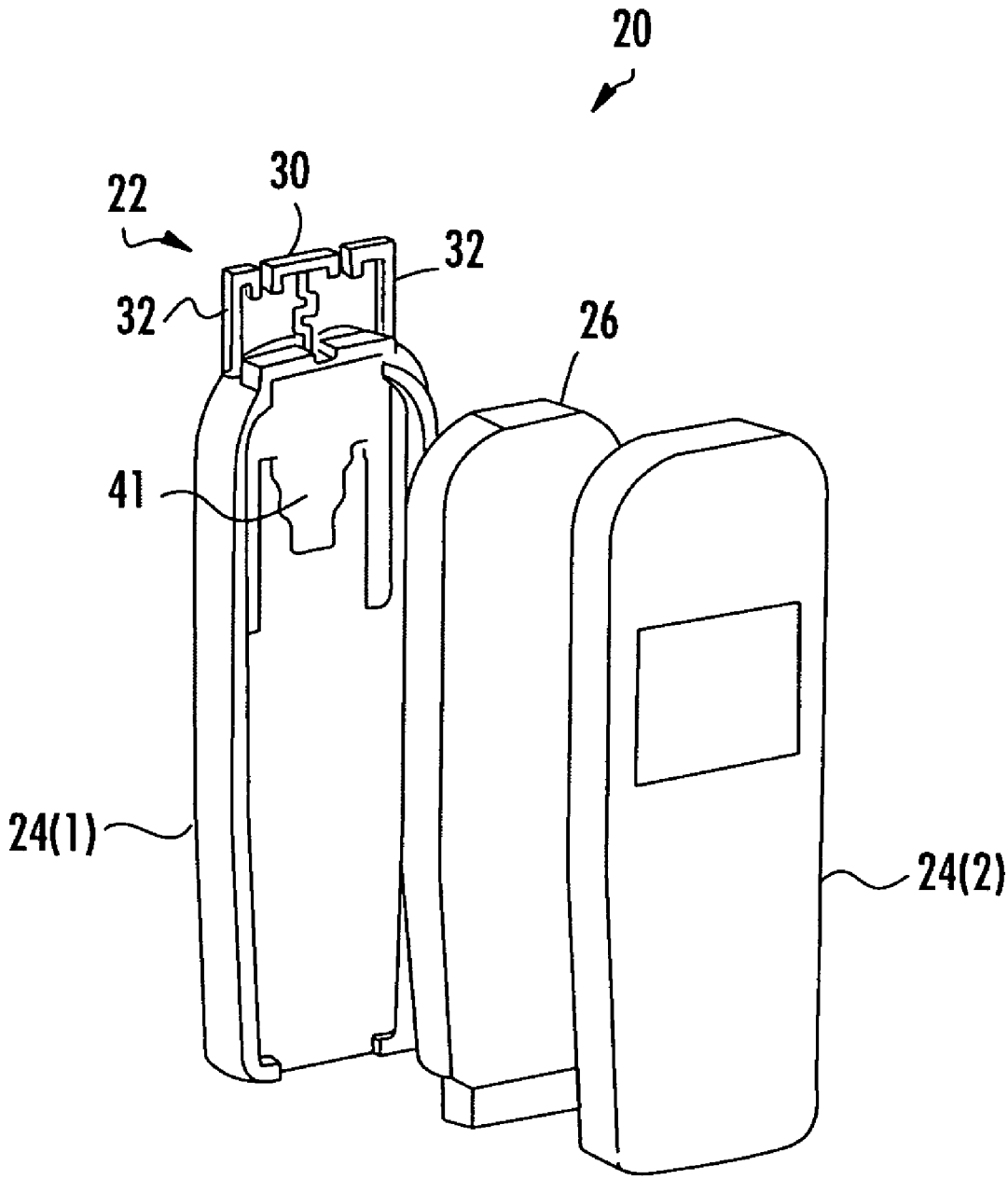
FIG. 2 is an exploded view illustrating integration of the smart antenna in the mobile subscriber unit shown in FIG. 1.

Referring initially to FIGS. 1 and 2, the illustrated mobile subscriber unit 20 includes a low-profile smart antenna 22. Even though the smart antenna 20 protrudes from the housing 24 of the mobile subscriber unit 20, the distance in which the active and passive antenna elements 30, 32 protrude has been reduced to improve portability and appearance. Although not illustrated, the active and passive antenna elements 30, 32 may optionally be covered with a protective coating or shield.

The smart antenna 22 provides for directional reception and transmission of radio communication signals with a base station in the case of a cellular handset, or from an access point in the case of a wireless data unit making use of wireless local area network (WLAN) protocols.

In the exploded view of FIG. 2 illustrating integration of the smart antenna 22 into the mobile subscriber unit 20, the smart antenna is formed on a printed circuit board and placed within a rear housing 24(1) of the mobile subscriber unit. A center module 26 may include electronic circuitry, radio reception and transmission equipment, and the like. An outer housing 24(2) may serve as, for example, a front cover of the mobile subscriber unit 20. When the rear and outer housings 24(1), 24(2) are connected together, they form the housing 24 of the mobile subscriber unit 20.

The printed circuit board implementation of the smart antenna 22 can easily fit within a handset form factor. In an alternate embodiment, the smart antenna 22 may be formed as an integral part of the center module 26, resulting in the smart antenna and the center module being fabricated on the same printed circuit board.

The ground portion 41 of the smart antenna 22 is embedded inside the housing 24. Protrusion of the active and passive antenna elements 30, 32 allows the elements to radiate freely. The form factor of the low-profile smart antenna 22 is more easily packaged into a handset as compared to the form factor of the smart antenna disclosed in the above referenced '331 patent.

Reducing the height of the active and passive antenna elements 30, 32 involves a number of steps. A first step is to reduce the height of the active antenna element 30 at the center. A second step is to reduce the height of the passive antenna elements 32 adjacent to the active antenna element 30 while preserving sufficient radiation coupling to perform beam forming and switching. A third step is to recover the gain lost due to the reduction in the size of the antenna elements 30, 32.

Figure 3:
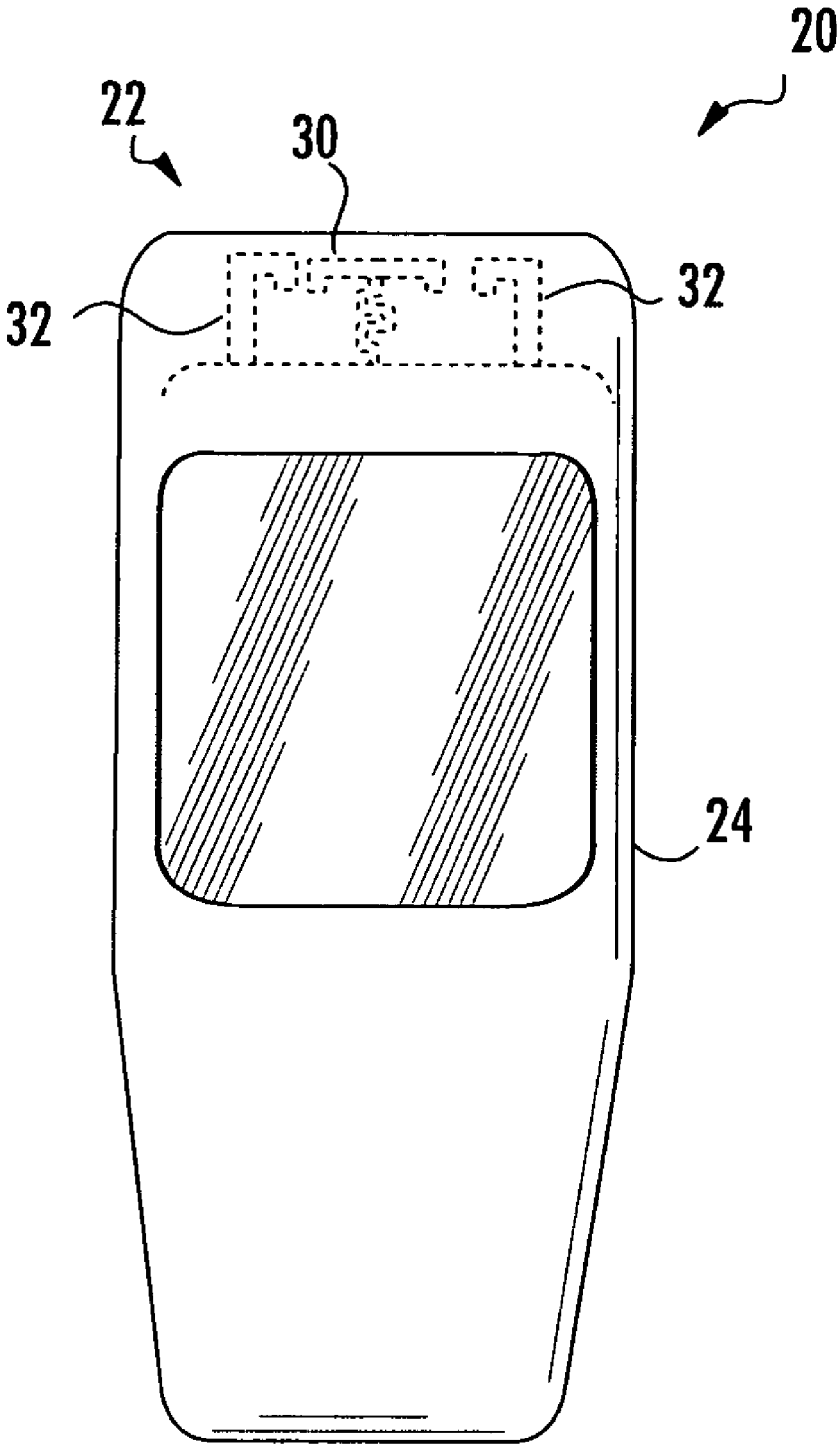
FIG. 3 is a schematic diagram of the smart antenna shown in FIG. 1 internal the mobile subscriber unit.
Figure 4:
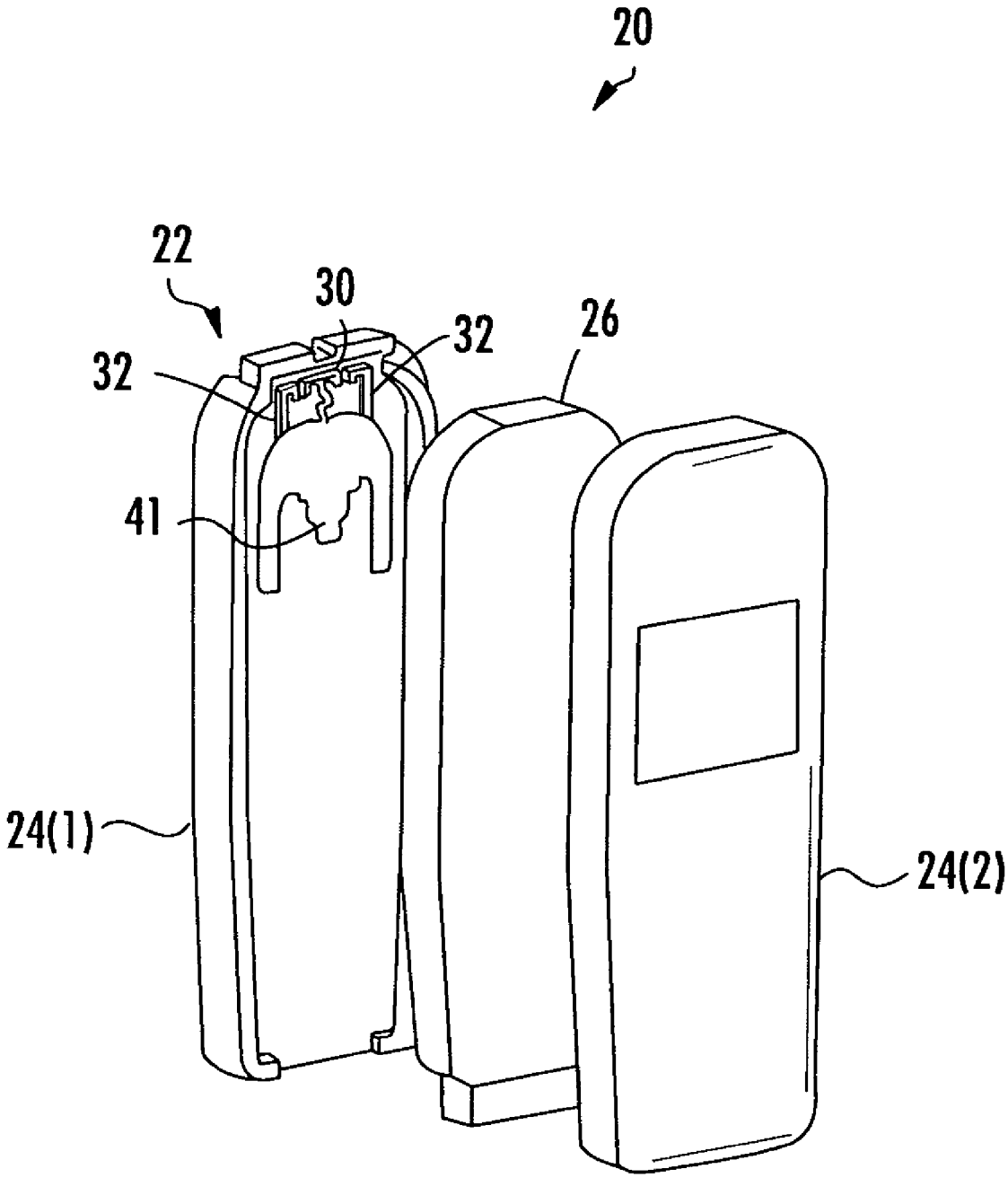
FIG. 4 is an exploded view illustrating integration of the smart antenna in the mobile subscriber unit shown in FIG. 3.

In other embodiments of the mobile subscriber unit, the smart antenna 22 may be internal the housing 24, as illustrated in FIGS. 3 and 4. In other words, the reduced height of the active and passive antenna elements 30, 32 advantageously allows the smart antenna 22 to be enclosed by the housing 24, as readily appreciated by those skilled in the art.

Figure 5:
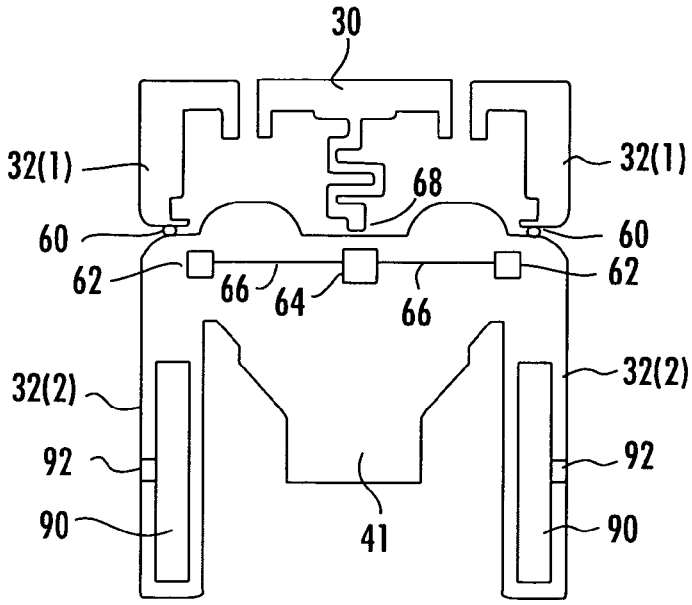
FIG. 5 is a schematic diagram of the smart antenna shown in FIGS. 1-4.
Figure 6:
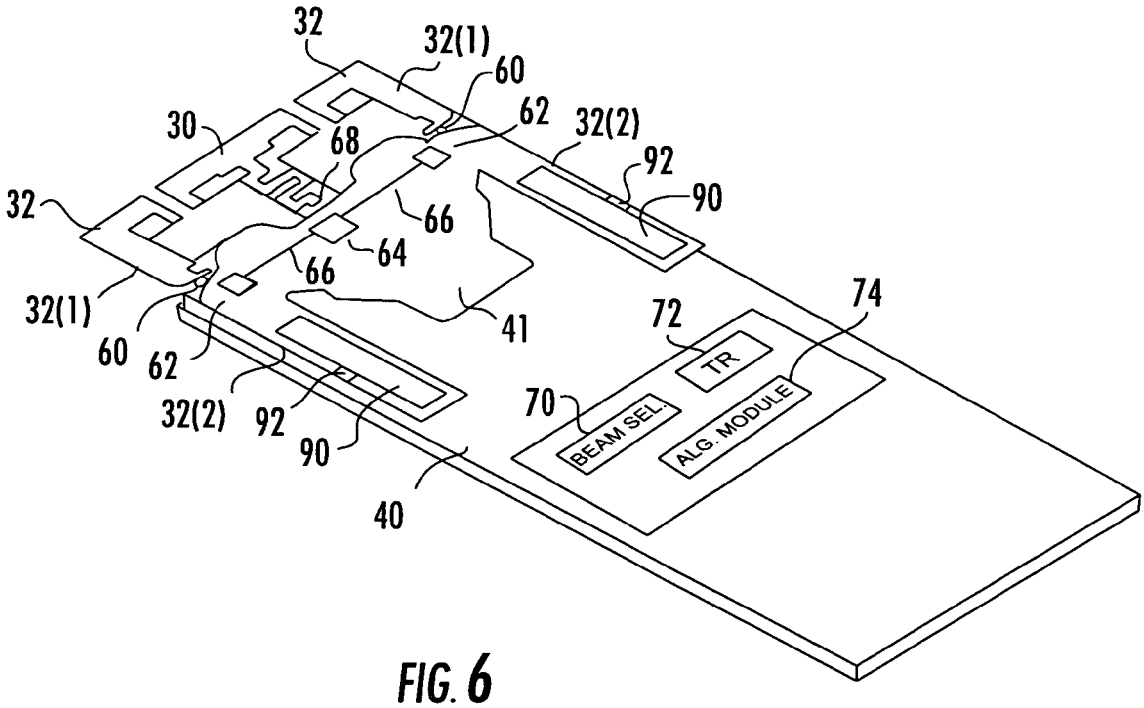
FIG. 6 is a schematic diagram of the smart antenna shown in FIG. 5 on a dielectric substrate in close proximity to other handset circuitry.
Figure 7:
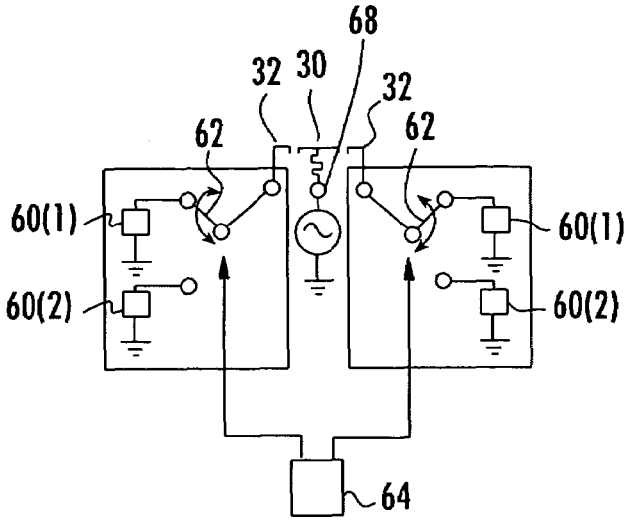
FIG. 7 is a schematic diagram of the switch and impedance elements for the passive antenna elements in accordance with the present invention.

The smart antenna 22 will now be discussed in greater detail with reference to FIGS. 5-7. The smart antenna 22 is disposed on a dielectric substrate 40 such as a printed circuit board, including the center active antenna element 30 and the outer passive antenna elements 32. Each of the passive antenna elements 32 can be operated in a reflective or directive mode, as will be discussed in greater detail below.

The active antenna element 30 comprises a conductive radiator in the shape of a "T" disposed on the dielectric substrate 40. The passive antenna elements 32 are also disposed on the dielectric substrate 40 and each comprises an inverted L-shaped portion laterally adjacent the active antenna element 30. The T-shaped active antenna element 30 and the L-shaped portions of the passive antenna elements 32 advantageously reduce the height of the smart antenna 22 protruding from the housing 24 of the mobile subscriber unit 20.

Reduction in the length of protrusion of the active antenna element 30 from the housing 24 of the mobile subscriber unit 20 is accomplished by providing a top loading, and at the same time providing a slow wave structure for the body of the antenna. The resulting active antenna element 30 has been reduced in height by more than 60%. This low profile design still provides the directional and omni-directional antenna patterns as in the above referenced '331 patent.

One of the technologies available for radiating element size reduction is meander-line technology. Other techniques can include dielectric loading, and corrugation, for example. The illustrated structure for the active antenna element 30 is a meander-line, which is illustrated as an example.

The active antenna element 30 and the passive antenna elements 32 are preferably fabricated from a single dielectric substrate such as a printed circuit board with the respective elements disposed thereon. The antenna elements 30, 32 can also be disposed on a deformable or flexible substrate The passive antenna elements 32 each has an upper conductive segment 32(1) (including the L-shaped portion) as well as a corresponding lower conductive segment 32(2). The height of the passive antenna elements 32 is reduced by bending the top portion thereof to produce the inverted L-shape. Alternatively, top loading may be used. A slow wave structure can be added to the body of the passive antenna elements 32, but it is not absolutely necessary. This is because the capacitive and inductive loads 60(1), 60(2) at the feed point can be adjusted to compensate for the height change, so it is not necessary to compensate on the passive antennas themselves.

The inverted L-shape is made to meet the top loading segment of the active antenna element 30, but not touching, in such a manner that more power can be coupled from the active antenna element 30 to the passive antenna elements 32 for optimum beam formation. The height of the active antenna element 30 and the upper conductive segment 32(1) of the passive antenna elements 32 shown in the figure is 0.6 inches, which is about 0.9 inches less than the corresponding height for the types of antenna elements illustrated in the '331 patent.

Gain is expected to be reduced when the physical size of the smart antenna 22 is reduced. In some size constrained cases, this gain reduction may be acceptable to meet packaging requirements. However, a variety of techniques can be used to reduce this loss. Since the desired height reduction is in the portion of the smart antenna 22 outside the housing 24, the length of the embedded portion, i.e., the lower conductive elements 32(2), can be increased to compensate for the reduced height.

This in effect turns the passive antenna elements 32 into offset fed dipoles. The passive antenna elements 32 are used to perform as a reflector/director element with controllable amplitude and phase. There is no input impedance for a reactive load 60 to match. In fact, a lossless mismatch is desired so the length change and offset feeding do not hinder performance of the smart antenna 22, as long as the loads 60 are low loss and the mismatch phase can be controlled.

For a passive antenna element 32 to operate in either a reflective or directive mode, the upper conductive segment 32(1) is connected to the lower conductive segment 32(2) via at least one impedance element 60. The at least one impedance element 60 comprises a capacitive load 60(1) and an inductive load 60(2), and each load is connected between the upper and lower conductive segments 32(1), 32(2) via a switch 62. The switch 62 may be a single pole, double throw switch, for example.

When the upper conductive segment 32(1) is connected to a respective lower conductive segment 32(2) via the inductive load 60(2), the passive antenna element 32 operates in a reflective mode. This results in radio frequency (RF) energy being reflected back from the passive antenna element 32 towards its source.

When the upper conductive segment 32(1) is connected to a respective lower conductive segment 32(2) via the capacitive load 60(2), the passive antenna element 32 operates in a directive mode. This results in RF energy being directed toward the passive antenna element 32 away from its source.

A switch control and driver circuit 64 provides logic control signals to each of the respective switches 62 via conductive traces 66. The switches 62, the switch control and driver circuit 64 and the conductive traces 66 may be on the same dielectric substrate 40 as the antenna elements 30, 32.

As noted above, electronic circuitry, radio reception and transmission equipment, and the like may be on the center module 26. Alternatively, this equipment may be on the same dielectric substrate 40 as the smart antenna 22. As illustrated in FIG. 6, this equipment includes a beam selector 70 for selecting the antenna beams, and a transceiver 72 coupled to a feed 68 of the active antenna element 30.

An antenna steering algorithm module 74 runs an antenna steering algorithm for determining which antenna beam provides the best reception. The antenna steering algorithm operates the beam selector 70 for scanning the plurality of antenna beams for receiving signals.

Performance of the illustrated low profile smart antenna 20 will now be discussed in reference to FIG. 8. The smart antenna 22 is operating at a frequency of 1.87 GHz, and four modes are available since a two-position switch 62 is used for each of the two passive antenna elements 32. The highest gain is 4 dBi, which corresponds to line 80. Line 80 represents one of the passive antenna elements in a directive mode with the other passive antenna element in a reflective mode. This is about 1½ dB lower than that of a similar smart antenna with full length elements of 1.5 inches, for example. The nulls are the same as deep, which is highly desirable for many interference rejection applications.

Figure 8:
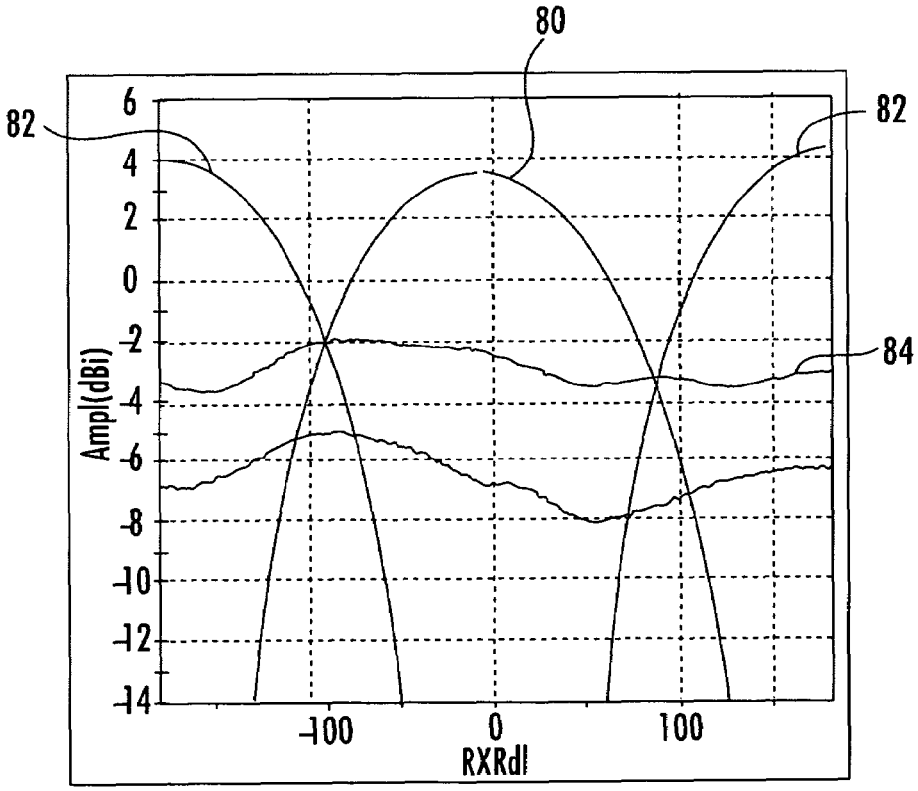
FIG. 8 is a graph illustrating various radiation patterns for the smart antenna shown in FIG. 1.

Still referring to the graph in FIG. 8, line 82 is similar to line 80 and represents a reverse in the reflective/directive modes for the respective passive antenna elements 32. The peak antenna gain corresponding to this reversal is represented by line 82. Line 82 has the same antenna gain as the antenna gain associated with line 80. Line 84 represents both of the passive antenna elements 32 in a directive mode, which corresponds to an omni-directional peak antenna gain of about 2 dBi. Line 86 represents both of the passive antenna elements 32 in a reflective mode, which corresponds to a peak antenna gain of about −5 dBi.

The lower conductive segments 32(2) may also comprise a loop 90 with an opening in one side thereof. An electronic component 92 is connected to the loop 90 across the opening therein. The electronic component 92 is a capacitor, for example. In other embodiments, the electronic component 92 may be an active device. The loop 90 with a variable reactance device or an electronic component 92 performs the role of tuning the smart antenna 22 in a more effective manner. In addition, the combination of the loop 90 and the electronic component 92 contributes to a reduction in the overall length of the antenna 22.

The efficiency as well as the bandwidth of the smart antenna 22 suffers much more significantly if the separation distance between the ground plane and the antenna is extremely small. The low profile smart antenna 22 shows significant improvement in its bandwidth when the antenna is at a height of about 1.75 mm above the ground plane 41. The improvement in the bandwidth and in the reduction of the overall length of the antenna 22 are attributed to the modified design encompassing the loop 90 on the lower conductive segments 32(2). The loop 90 and the electronic component 92 associated therewith can be effectively used to counter any ill effects of the coupling resulting from the close proximity of the antenna 22 to the ground plane 41.

The separation distance between the antenna 22 and the ground plane 41 can be as little as 1.75 mm. The low-profile smart antenna 22 can still be fabricated on the printed circuit board 40. The dimensional details as well as the relative position of the antenna with respect to the ground plane 41 are suitable for integration into either a flip or non-flip version of a cellular handset.

Yet another aspect of the present invention is to provide a low profile, dual-band smart antenna 22'. In mobile communication systems, multi-band operation is usually required. For example, the operating bands may be 824 MHz to 960 MHz, and 1.75 GHz to 2.5 GHz, for example. Other operating bands for a mobile subscriber unit are also applicable, as readily appreciated by those skilled in the art. The smart antenna 22 as discussed above operates over the frequency range of 1.75 GHz to 2.5 GHz, i.e., the high-band, for example.

Figure 9:
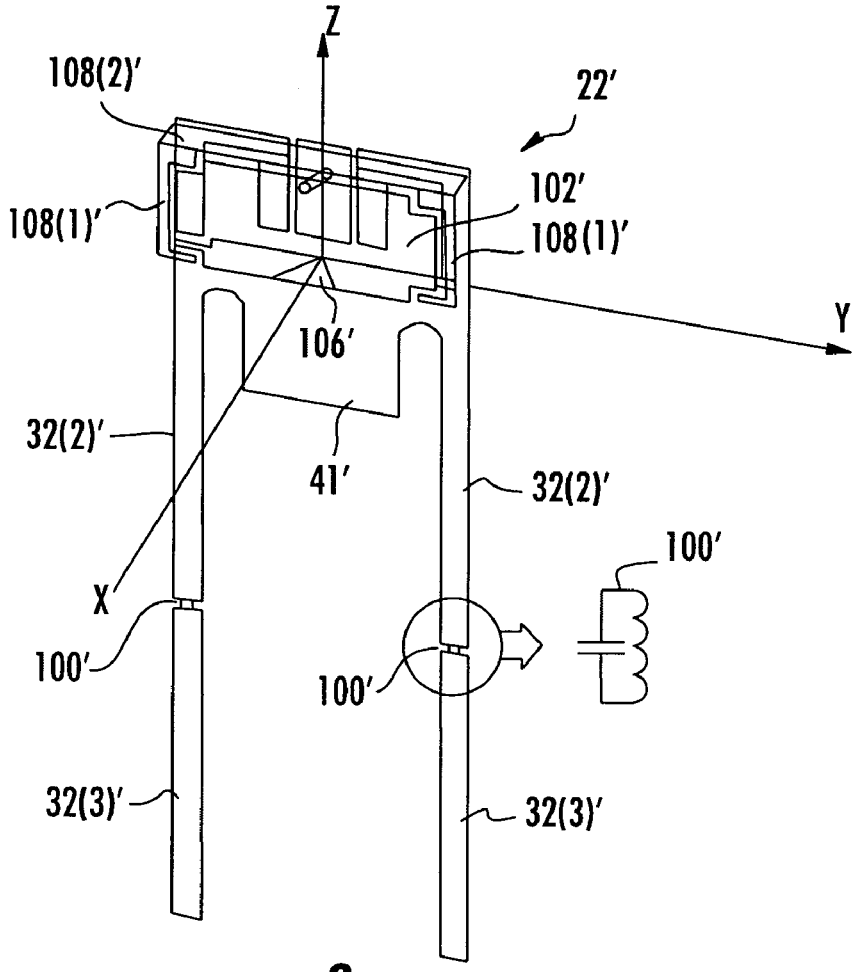
FIG. 9 is a schematic diagram of a dual-band smart antenna in accordance with the present invention.

Referring now to FIGS. 9-12, the smart antenna 22' is modified to also operate over the frequency range of 824 MHz to 960 MHz, i.e., the low-band, for example. The ground portion 41' provides the resonance counterpart of the antenna 22', and a platform for electronic circuits that control operation of the smart antenna. The high-band (1.75 GHz to 2.5 GHz) is supported by the lower conductive segments 32(2). The low-band is supported by conductive extension segments 32(3)' and switches 100' connected to the lower conductive segments 32(2)'. Each switch 100' may be a filter, such as LC tank circuit, for example, as shown in FIG. 9.

When operating in the high-band, the filters 100' cause the conductive extension elements 32(3)' to appear as if they are not connected to the ground plane 41'. In contrast, when operating in the low-band, the filters 100' cause the conductive extension elements 32(3)' to appear as if they are connected to the ground plane 41'.

Figure 10:
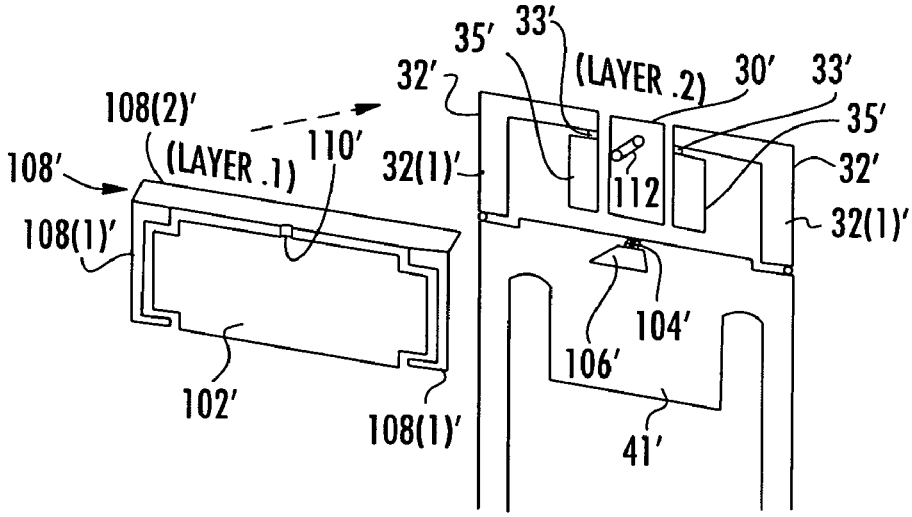
FIG. 10 is an exploded view of a portion of the dual-band smart antenna shown in FIG. 9.
Figure 11:
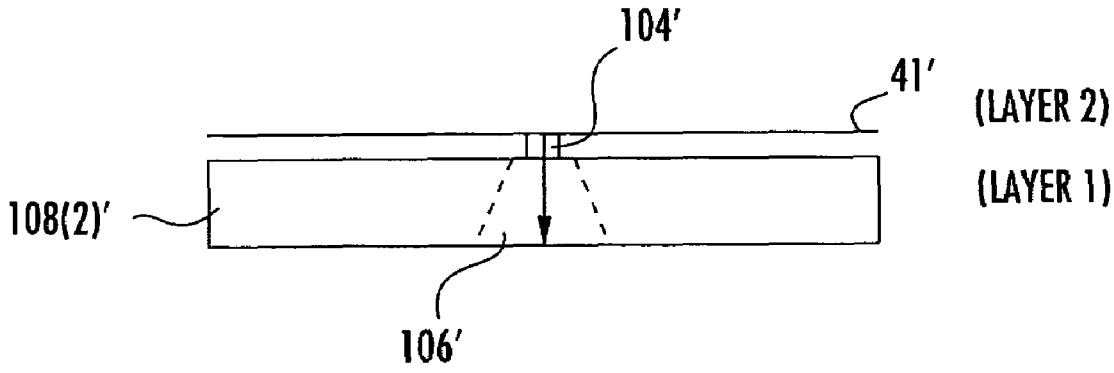
FIG. 11 is a top plane view of the RF input for the conductive plate shown in FIG. 10.
Figure 12:
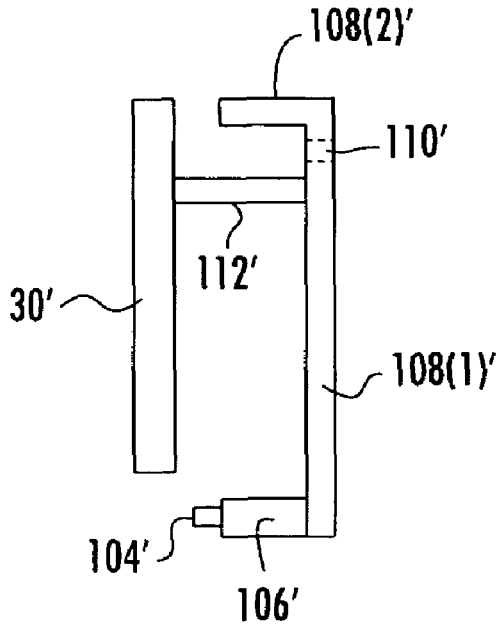
FIG. 12 is a side view of the conductive plate shown in FIG. 10.

The top portion of the smart antenna 22' assembly is a planar two-layer structure. The active antenna element 30' may have the T-shape as discussed above, or it may have a rectangular shape, as best illustrated in FIGS. 9 and 10. This portion of the active antenna element 30' supports operation in the high-band.

To support operation in the low-frequency band, a second active antenna element 102' is electrically connected to the active antenna element 30' via a conductive post 112'. The second active antenna element 102' is connected to an RF input 104' through an inter-layer tapered conducting strip 106'. Instead of the RF input 104' being connected to the active antenna element 30' as discussed above, the RF input is connected to the second active antenna element 102'. An exploded view of the dual-band smart antenna 22' is provided in FIG. 10.

The second active antenna element 102' may comprise a patch conductor, a loop or a meandering line, for example. The second active antenna element 102' and its top-loading part 108' are located in layer 1. The top-loading part 108' comprises side portions 108(1)' and a top portion 108(2)' that is bent or angled with respect to the side portions. This helps to maintain the low profile of the smart antenna 22'.

The RF input 104' is supported by the RF circuit structure formed on the dielectric substrate 40' which is in layer 2, or in the center module 26'. The smart antenna assembly 22' occupies a small physical volume, and also operates at the low 800 MHz frequency band in addition to the high-band.

To make both the second active antenna element 102' and the metal strips 108(1)' as big as possible, part of the metal strip 108(2)' is bent towards the direction of layer 2, as noted above. The bent part 108(2)' is connected to the metal strips 108(1)' and forms a monolithic piece. The metal strips 108(1)', together with the bent part 108(2)', are connected to the second active antenna element 102' through an impedance element 110', such as lump inductor, for example.

The passive antenna elements 32' have inverted-L shapes, which provide a reduced height in z-direction while maintaining electrical performance, as noted above. The two small conductive plates 35' that form the L-shape may be connected to the upper conductive segments 32(1)' through a lump impedance element 33' for providing input impedance matching adjustment. The conductive plates 35' also greatly improve the return loss of the dual-band smart antenna 22'.

There are several advantages to the dual-band smart antenna 22'. The radiating part of the antenna structure is miniaturized, which can fit into cell phones and other handheld wireless devices from most manufacturers. The antenna 22' is made on a two-layer planar structure, which can be fabricated with printed circuit technology at low cost.

The two filters 100' improve performance in the lower band, as well as provide a way to adjust direction of the antenna beams in the elevation plane. The two small conductive plates 35' together with the lump elements 33' help to control the input impedance of the antenna 22'. This greatly improves antenna matching to the single RF input port 104', in both the omni-directional antenna beam mode and the directional antenna beam modes.

The lower band, frequency f1, is realized by using a tapered feeding structure, together with top-loading technology. This makes it possible to be operable within a relatively small physical volume. This antenna embodiment is also capable of operating in a dual or tri-band. The antenna may be operated at frequencies f1, f2, f3, where f1<f2<f3, and f1 is about half of f2. The lower band f1 may cover the 800 MHz band (GSM, AMPS), whereas the higher bands may cover 1.75 GHz to 2.5 GHz (PCS, 802.11b), for example. In other words, the high-band can still be split into several bands, as readily appreciated by those skilled in the art.

In addition to the filters 100' improving performance in the low-band, the filters also provide a way of adjusting the beam direction in the elevation plane. The smart antenna 22' is capable of producing two directional antenna beams pointing to opposite directions, in addition to an omni-directional antenna beam.

Figure 13:
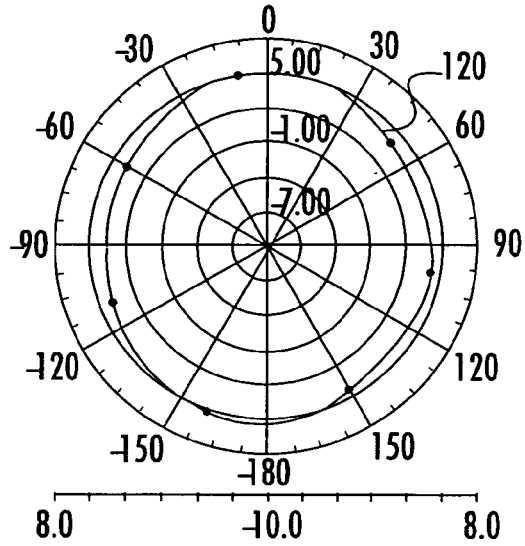
FIG. 13 is a graph illustrating a radiation pattern at high-band for the dual-band smart antenna shown in FIG. 9.
Figure 14:
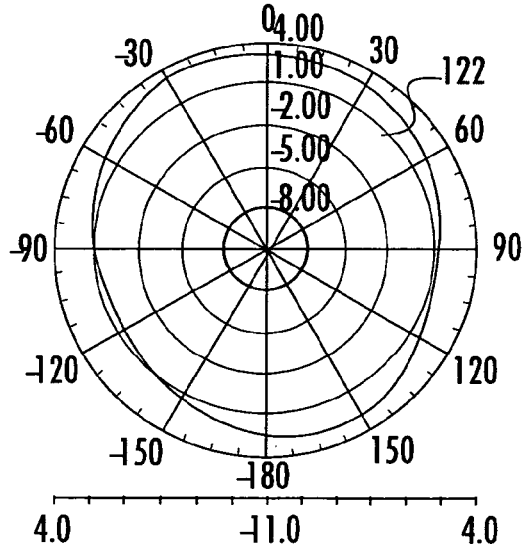
FIG. 14 is a graph illustrating a radiation pattern at low-band for the dual-band smart antenna shown in FIG. 9.
Figure 15:
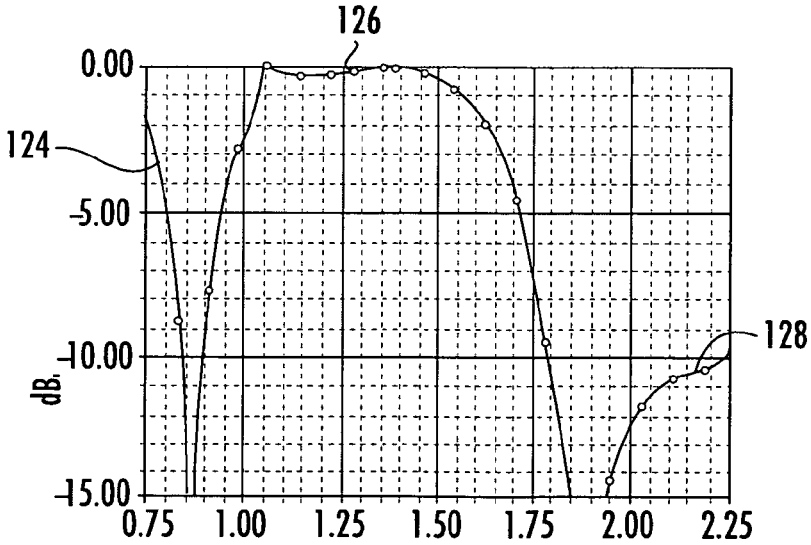
FIG. 15 is a graph illustrating return loss for the dual-band smart antenna shown in FIG. 9.

Radiation patterns for the low profile, dual-band smart antenna 22' are provided in FIGS. 13 and 14. Line 120 represents the pattern of an omni-directional antenna beam at high-band. Likewise, line 122 represents the pattern of an omni-directional antenna beam at low-band. A typical frequency response of the return loss of the dual-band smart antenna 22' is provided in FIG. 15. The dual-band characteristics can be clearly identified, as indicated by lines 124, 126 and 128.

Yet another aspect of the present invention is to provide a method for making a smart antenna 22 comprising forming an active antenna element 30 on a dielectric substrate 40, wherein the active antenna element has a T-shape. The method further comprises forming at least one passive antenna element 32 on the dielectric substrate 40, wherein the at least one passive antenna element comprises an inverted L-shaped portion laterally adjacent the active antenna element 30. At least one impedance element 60 is formed on the dielectric substrate 40, and is selectively connectable to the at least one passive antenna element 32 for antenna beam steering.

Many modifications and other embodiments of the invention will come to the mind of one skilled in the art having the benefit of the teachings presented on the foregoing descriptions and the associated drawings. Therefore, it is understood that the invention is not toe be limited to the specific embodiments disclosed, and that modifications and embodiments are intended to be included within the scope of the appended claims.

That which is claimed is:

1. A smart antenna comprising:

a dielectric substrate;

an active antenna element carried by said dielectric substrate and coplanar therewith, said active antenna element having a T-shape;

at least one passive antenna element carried by said dielectric substrate and coplanar therewith, said at least one passive antenna element comprising an inverted L-shaped portion laterally adjacent said active antenna element;

at least one impedance element selectively connectable to said at least one passive antenna element for antenna beam steering; and at least one switch carried by said dielectric substrate for selectively connecting said at least one passive antenna element to said at least one impedance element.

2. A smart antenna according to claim 1 wherein said active antenna element includes a bottom portion and a top portion connected thereto for defining the T-shape, and wherein the bottom portion has a meandering shape.

3. A smart antenna according to claim 2 wherein the top portion is symmetrically arranged with respect to the first portion, and includes a pair of inverted L-shaped ends.

4. A smart antenna according to claim 1 wherein said at least one passive antenna element further comprises a first elongated portion connected to said at least one impedance element.

5. A smart antenna according to claim 4 wherein each impedance element is associated with a respective passive antenna element, each impedance element comprising an inductive load and a capacitive load, with said inductive load and said capacitive load being selectively connectable to the respective passive antenna element.

6. A smart antenna according to claim 4 wherein each first elongated portion comprises a loop with an opening in one side thereof.

7. A smart antenna according to claim 6 wherein each first elongated portion further comprises an impedance element connected to said loop across the opening therein.

8. A smart antenna according to claim 1 further comprising a ground plane connected to said at least one impedance element.

9. A smart antenna according to claim 4 wherein said active antenna element is sized to operate in a high frequency band; and further comprising:

a second active antenna element connected in parallel to said active antenna element and sized to operate in a low frequency band;

a switch connected to each first elongated portion;

a second elongated portion connected to each switch; and said switch connecting said second elongated portion to said first elongated portion when said second active antenna element is operating in the low frequency band.

10. A smart antenna according to claim 9 wherein said second active antenna element comprises at least one of a patch conductor, a loop and a meandering line.

11. A smart antenna according to claim 9 wherein the low frequency band has a frequency range that is about half of a frequency range of the high frequency band.

12. A smart antenna according to claim 9 wherein said switch comprises a filter.

13. A smart antenna according to claim 9 further comprising a tapered RF input coupled to said second antenna element.

14. A smart antenna according to claim 13 further comprising:

an impedance element connected to said second active antenna element; and a conducting strip connected to said impedance element for top-loading said second active antenna element.

15. A smart antenna according to claim 14 wherein said conducting strip comprises:

side portions adjacent to sides of said second active antenna element; and a top portion extending in an angled direction with respect to said second antenna element.

16. A smart antenna according to claim 9 wherein said inverted L-shaped portion of said at least one passive antenna element comprises:

an impedance element; and a conductive plate connected to said impedance element.

17. A mobile subscriber unit comprising:

a smart antenna for generating a plurality of antenna beams;

a beam selector controller connected to said smart antenna for selecting one of said plurality of antenna beams; and a transceiver connected to said beam selector and to said smart antenna;

said smart antenna comprising a dielectric substrate, an active antenna element carried by said dielectric substrate and coplanar therewith, said active antenna element having a T-shape, at least one passive antenna element carried by said dielectric substrate and coplanar therewith, said at least one passive antenna element laterally adjacent said active antenna element, at least one impedance element selectively connectable to said at least one passive antenna element for antenna beam steering, and at least one switch carried by said dielectric substrate for selectively connecting said at least one passive antenna element to said at least one impedance element based on said beam selection controller.

18. A mobile subscriber unit according to claim 17 wherein said at least one passive antenna element comprises an inverted L-shaped portion.

19. A mobile subscriber unit according to claim 17 wherein said active antenna element includes a bottom portion and a top portion connected thereto for defining the T-shape, and wherein the bottom portion has a meandering shape.

20. A mobile subscriber unit according to claim 19 wherein the top portion is symmetrically arranged with respect to the first portion, and includes a pair of inverted L-shaped ends.

21. A mobile subscriber unit according to claim 17 further comprising a first elongated portion connected to said at least one impedance element.

22. A mobile subscriber unit according to claim 21 wherein each first elongated portion comprises a loop with an opening in one side thereof.

23. A mobile subscriber unit according to claim 22 wherein each first elongated portion further comprises an impedance element connected to said loop across the opening therein.

24. A mobile subscriber unit according to claim 17 further comprising a ground plane connected to said at least one impedance element.

25. A mobile subscriber unit according to claim 21 wherein said active antenna element is sized to operate in a high frequency band; and further comprising:

a second active antenna element connected in parallel to said active antenna element and sized to operate in a low frequency band;

a switch connected to each first elongated portion;

a second elongated portion connected to each switch; and said switch connecting said second elongated portion to said first elongated portion when said second active antenna element is operating in the low frequency band.

26. A mobile subscriber unit according to claim 25 further comprising:

an impedance element connected to said second active antenna element; and a conducting strip connected to said impedance element for top-loading said second active antenna element.

27. A mobile subscriber unit according to claim 26 wherein said conducting strip comprises side portions adjacent to sides of said second active antenna element, and a top portion extending in an angled direction with respect to said second active antenna element.

28. A mobile subscriber unit according to claim 17 further comprising a housing for enclosing said smart antenna including said active and passive antenna elements, said beam selector controller and said transceiver.

29. A method for making a smart antenna comprising:

forming an active antenna element on a dielectric substrate, the active antenna element having a T-shape and coplanar with the dielectric substrate;

forming at least one passive antenna element on the dielectric substrate, the at least one passive antenna element comprising an inverted L-shaped portion laterally adjacent the active antenna element and coplanar with the dielectric substrate;

forming at least one impedance element on the dielectric substrate that is selectively connectable to the at least one passive antenna element for antenna beam steering; and forming at least one switch on the dielectric substrate for selectively connecting the at least one passive antenna element to the at least one impedance element.

30. A method according to claim 29 wherein the active antenna element includes a bottom portion and a top portion connected thereto for defining the T-shape, and wherein the bottom portion has a meandering shape.

31. A method according to claim 30 wherein the top portion is symmetrically arranged with respect to the first portion, and includes a pair of inverted L-shaped ends.

32. A method according to claim 29 wherein the at least one passive antenna element further comprises a first elongated portion connected to the L-shaped portion via the at least one impedance element.

33. A method according to claim 32 wherein each first elongated portion comprises a loop with an opening in one side thereof; and an impedance element connected to the loop across the opening therein.

34. A method according to claim 32 wherein the active antenna element is sized to operate in a high frequency band; and further comprising:

connecting a second active antenna element in parallel to the active antenna element, the second active antenna element being sized to operate in a low frequency band;

connecting a switch to each first elongated portion;

connecting a second elongated portion to each switch; and operating the switch for connecting the second elongated portion to the first elongated portion when the second active antenna element is operating in the low frequency band.

* * * * *